US012221735B2

(12) United States Patent
Hettinger et al.

(10) Patent No.: US 12,221,735 B2
(45) Date of Patent: Feb. 11, 2025

(54) LAUNDRY TREATMENT APPLIANCE INCORPORATING A HEATED WATER REPLENISHMENT METHOD

(71) Applicant: Haier US Appliance Solutions, Inc., Wilmington, DE (US)

(72) Inventors: Stephen Edward Hettinger, Louisville, KY (US); Ryan Ellis Leonard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 928 days.

(21) Appl. No.: 17/172,593

(22) Filed: Feb. 10, 2021

(65) Prior Publication Data

US 2022/0251752 A1 Aug. 11, 2022

(51) Int. Cl.

| | |
|---|---|
| ***D06F 33/36*** | (2020.01) |
| ***D06F 33/34*** | (2020.01) |
| ***D06F 33/44*** | (2020.01) |
| *D06F 103/20* | (2020.01) |
| *D06F 105/02* | (2020.01) |

(52) U.S. Cl.

CPC ..... *D06F 33/36* (2020.02); *D06F 33/34* (2020.02); *D06F 33/44* (2020.02); *D06F 2103/20* (2020.02); *D06F 2105/02* (2020.02)

(58) Field of Classification Search

CPC ..... D06F 33/34; D06F 33/36; D06F 33/44; D06F 33/46; D06F 33/54; D06F 33/56; D06F 33/70; D06F 33/72; D06F 2103/16; D06F 2103/20; D06F 2105/02; D06F 2105/04; D06F 2105/10; D06F 2105/52; D06F 2105/54; D06F 2105/56; D06F 34/22; D06F 2101/14; D06F 2101/20; D06F 2103/38

See application file for complete search history.

(56) References Cited

U.S. PATENT DOCUMENTS

| | | | | |
|---|---|---|---|---|
| 9,410,280 | B2 | 8/2016 | Hettinger | |
| 2008/0189874 | A1 | 8/2008 | Yoon | |
| 2015/0204004 | A1* | 7/2015 | Hettinger | D06F 34/28 68/133 |
| 2016/0201247 | A1* | 7/2016 | Hettinger | D06F 39/087 68/12.12 |
| 2021/0095408 | A1* | 4/2021 | Lee | D06F 33/36 |
| 2022/0034015 | A1* | 2/2022 | David | D06F 33/37 |

FOREIGN PATENT DOCUMENTS

KR 20010093953 A 10/2001

* cited by examiner

*Primary Examiner* — David G Cormier
(74) *Attorney, Agent, or Firm* — Dority & Manning, P.A.

(57) ABSTRACT

A method for operating a laundry apparatus, the laundry apparatus including a tub and a detergent dispenser, the method including initiating a washing cycle of a washing load; supplying a first fill of heated water and a dose of detergent to the tub via the detergent dispenser; performing a first agitation phase of the washing cycle; determining that a two-phase heated water fill condition exists; supplying a second fill of heated water to the tub; and performing a second agitation phase of the washing cycle.

9 Claims, 4 Drawing Sheets

LAUNDRY TREATMENT APPLIANCE INCORPORATING A HEATED WATER REPLENISHMENT METHOD

FIELD OF THE INVENTION

The present subject matter relates generally to laundry treatment appliances, and more particularly to methods for replenishing heated water in laundry treatment appliances.

BACKGROUND OF THE INVENTION

Laundry treatment apparatuses generally include a drum or basket rotatably mounted within a tub of a cabinet. The basket defines a wash chamber for receiving articles for washing. During operation, wash fluid is directed into the tub and onto articles within the wash chamber. The wash fluid may be a mixture of water and one or more additives, such as e.g., liquid detergent, powder detergent, bleach, softener, etc. Typically, a dispensing assembly dispenses or directs the wash fluid into the tub.

Particular wash cycles of certain laundry treatment apparatuses typically utilize hot or heated water to perform a cleaning operation. During the wash cycle, hot water is mixed with an additive to form a wash fluid and supplied to the basket. Mixing in a dose of detergent with a large amount of water results in a low concentration of detergent and subsequently a reduced washing efficiency. Moreover, in some instances, certain conditions exist which reduce the temperature of the water being used in the wash cycle. For example, a lengthy wash cycle leads to the water (or wash fluid) dropping to a lower temperature before the completion of a washing cycle, leading to incomplete washing or reduced cleaning effectiveness. Additionally or alternatively, certain wash cycles may require additional hot water to account for certain wash articles.

Therefore, a laundry treatment apparatus that addresses one or more of the challenges noted above would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a laundry treatment apparatus is provided. The laundry apparatus may include a tub. The method may include initiating a washing cycle of a washing load; determining that a two-phase heated water fill condition exists; supplying a first fill of heated water and a dose of detergent to the tub; performing a first agitation phase of the washing cycle; supplying a second fill of heated water to the tub; and performing a second agitation phase of the washing cycle.

In another exemplary aspect of the present disclosure, a laundry treatment apparatus is provided. The laundry treatment apparatus may include a tub provided in a cabinet and configured to hold water; a basket rotatably provided within the tub and configured to hold a washing load; and a controller configured to perform a series of operations. The series of operations may include initiating a washing cycle of the washing load; determining that a two-phase heated water fill condition exists; supplying a first fill of heated water and a dose of detergent to the tub; performing a first agitation phase of the washing cycle; supplying a second fill of heated water to the tub; and performing a second agitation phase of the washing cycle.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
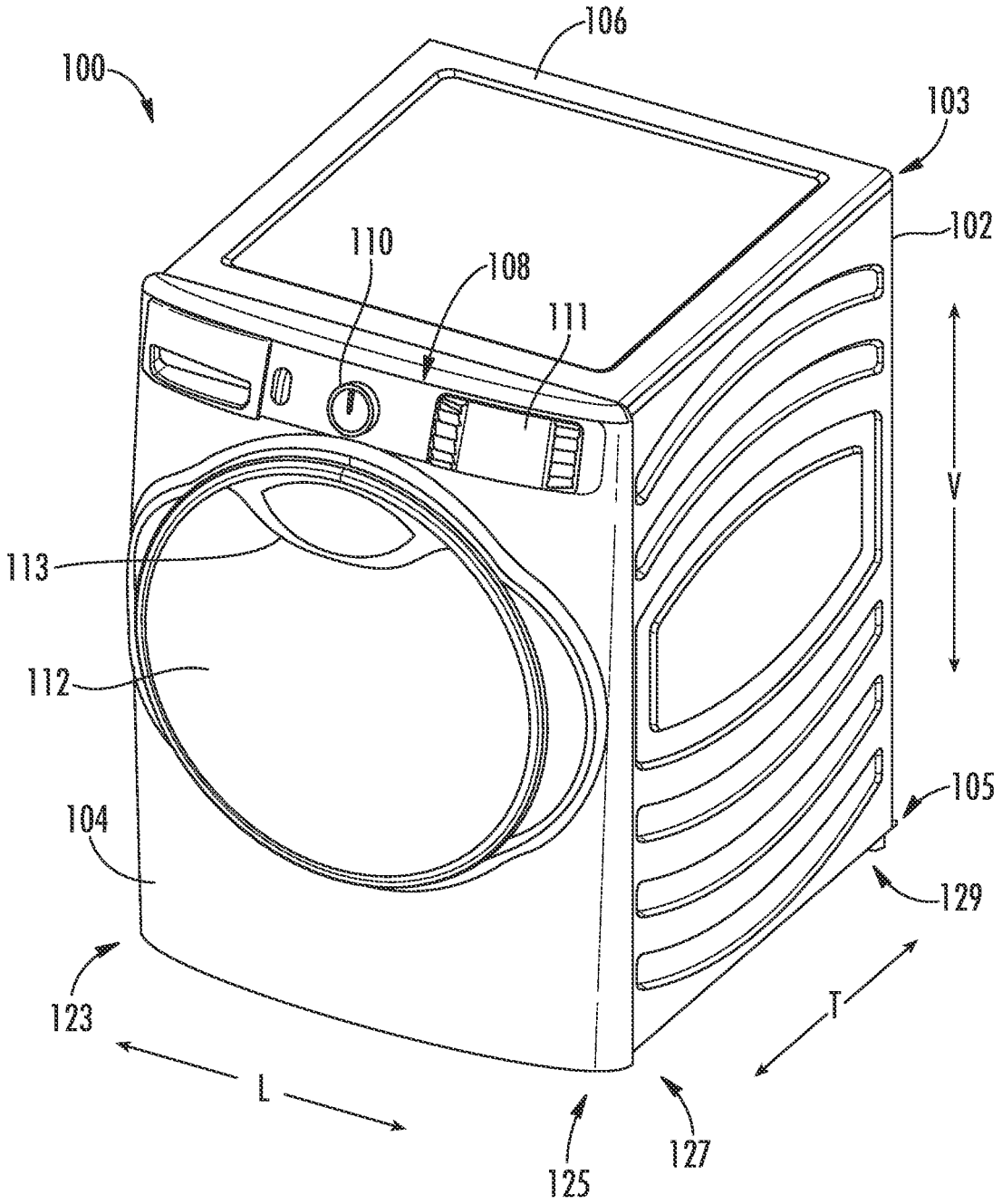
FIG. 1 provides a front, perspective view of a laundry treatment apparatus according to an exemplary embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
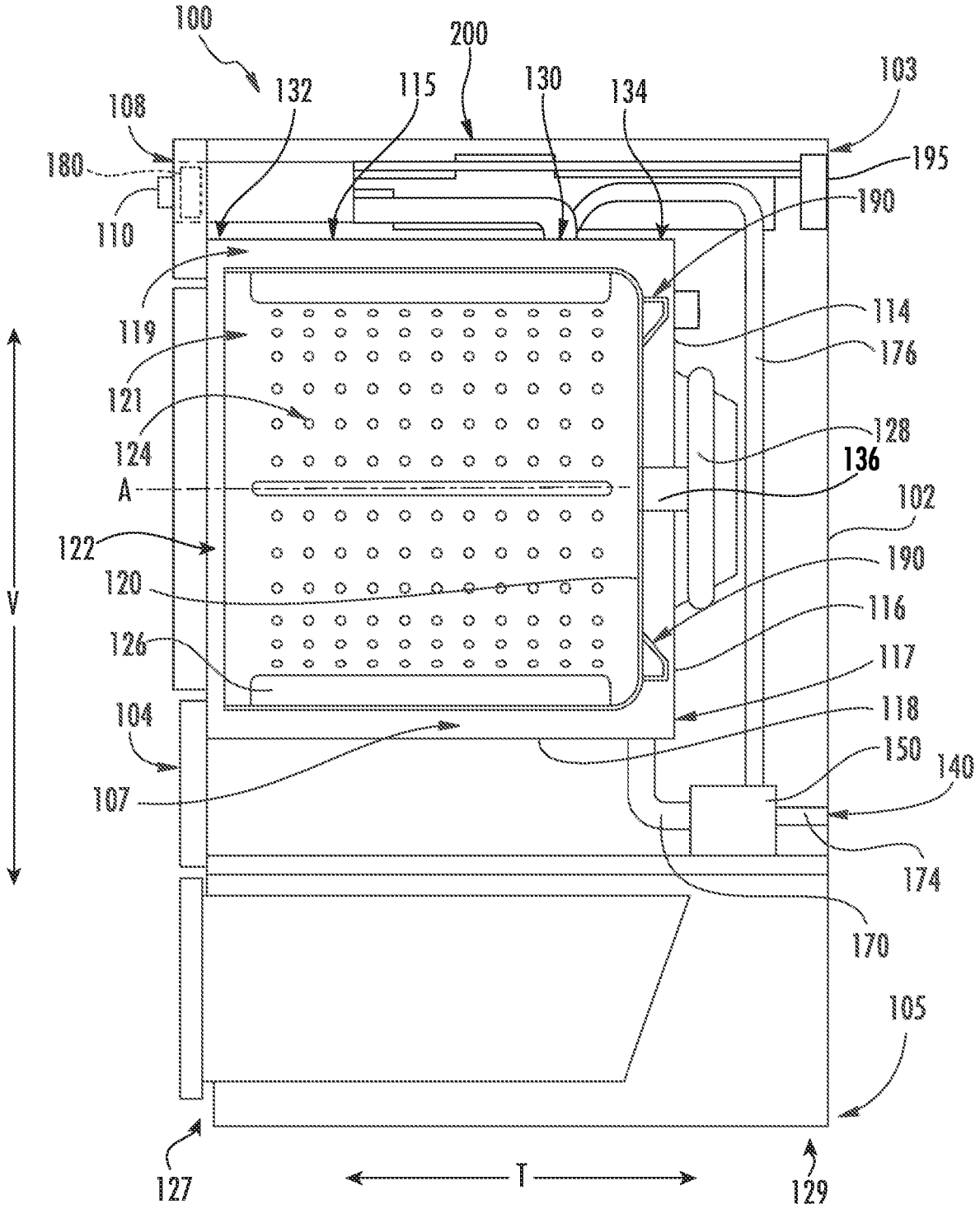
FIG. 2 provides a side, cross-sectional view of the exemplary laundry treatment apparatus appliance of FIG. 1.

FIGS. 1 and 2 provide various views of an exemplary laundry treatment apparatus 100 according to one exemplary embodiment of the present disclosure. In particular, FIG. 1 provides a front, perspective view of horizontal axis laundry treatment apparatus 100 and FIG. 2 provides a side, section view of laundry treatment apparatus 100. As shown in FIG. 1, laundry treatment apparatus 100 includes a cabinet 102 that extends between a top 103 and a bottom 105, e.g., along a vertical direction V. Cabinet 102 also extends between a first side 123 and a second side 125, e.g., along a lateral direction L, and between a front 127 and a rear 129, e.g., along a transverse direction T. The vertical, lateral, and transverse directions V, L, T defined by laundry treatment apparatus 100 are mutually perpendicular and together define an orthogonal direction system.

Cabinet 102 includes a front panel 104. A door 112 may be mounted to front panel 104 and may be rotatable between an open position (not shown) facilitating access to a wash drum or basket 120 (FIG. 2) located within cabinet 102, and a closed position (shown in FIGS. 1 and 2) hindering access to basket 120. A user may pull on a handle 113 in order to selectively adjust door 112 between the open and closed positions. Cabinet 102 also includes a top panel 106 positioned at top 103 of cabinet 102.

A control panel 108 including a plurality of input selectors 110 may be coupled to front panel 104. Control panel 108 and input selectors 110 collectively form a user interface input for operator selection of machine cycles and features. For example, in some embodiments, control panel 108 includes a display 111 (FIG. 1) configured to present or indicate selected features, a countdown timer, and/or other items of interest to machine users.

As shown in FIG. 2, a tub 114 defines a wash fluid compartment 119 configured for receipt of a washing fluid. Thus, tub 114 is configured for containing washing fluid, e.g., during operation of laundry treatment apparatus 100. Washing fluid disposed within tub 114 may include, for example, at least one of water, fabric softener, bleach, and detergent. Tub 114 includes a back wall 116 and a sidewall 118 and extends between a top 115 and a bottom 117, e.g., along the vertical direction V. Further, tub 114 extends between a front 132 and a rear 134, e.g., along the transverse direction T.

Basket 120 is rotatably mounted within tub 114 in a spaced apart relationship from tub sidewall 118 and tub back wall 116. One or more bearing assemblies may be placed between basket 120 and tub 114 and may allow for rotational movement of basket 120 relative to tub 114. Basket 120 defines a wash chamber 121 and an opening 122. Opening 122 of basket 120 permits access to wash chamber 121 of basket 120, e.g., in order to load articles into basket 120 and remove articles from basket 120. Basket 120 also defines a plurality of perforations 124 to facilitate fluid communication between an interior of basket 120 and tub 114. A sump 107 is defined by tub 114 and is configured for receipt of washing fluid during operation of appliance 100. For example, during operation of appliance 100, washing fluid may be urged by gravity from basket 120 to sump 107 through plurality of perforations 124.

A spout 130 is configured for directing a flow of fluid into tub 114. Spout 130 may be in fluid communication with a water supply (not shown) in order to direct fluid (e.g., clean water) into tub 114. A pump assembly 150 (shown schematically in FIG. 2) is located beneath tub 114 for draining tub 114 of fluid. Pump assembly 150 is in fluid communication with sump 107 of tub 114 via a conduit 170. Thus, conduit 170 directs fluid from tub 114 to pump assembly 150. Pump assembly 150 is also in fluid communication with a drain 140 via piping 174. Pump assembly 150 can urge fluid disposed in sump 107 to drain 140 during operation of appliance 100 in order to remove fluid from tub 114. Fluid received by drain 140 from pump assembly 150 is directed out of appliance 100, e.g., to a sewer or septic system.

In addition, pump assembly 150 is configured for recirculating washing fluid within tub 114. Thus, pump assembly 150 is configured for urging fluid from sump 107, e.g., to spout 130. For example, pump assembly 150 may urge washing fluid in sump 107 to spout 130 via hose 176 during operation of appliance 100 in order to assist in cleaning articles disposed in basket 120. It should be understood that conduit 170, piping 174, and hose 176 may be constructed of any suitable mechanism for directing fluid, e.g., a pipe, duct, conduit, hose, or tube, and are not limited to any particular type of mechanism.

A motor 128 is in mechanical communication with basket 120 in order to selectively rotate basket 120, e.g., during an agitation or a rinse cycle of laundry treatment apparatus 100 as described below. In particular, a shaft 136 mechanically couples motor 128 with basket 120 and drivingly rotates basket 120 about a shaft or central axis A, e.g., during a spin cycle. Ribs 126 may extend from basket 120 into wash chamber 121. Ribs 126 may assist agitation of articles disposed within wash chamber 121 during operation of laundry treatment apparatus 100. For example, ribs 126 may lift articles disposed in basket 120 during rotation of basket 120.

Also shown in FIG. 2 is a balancing apparatus 190. Balancing apparatus 190 can include a balancing ring, for example. The balancing ring can have an annular cavity in which a balancing material is free to rotate and move about. For example, the balancing material can be a fluid such as water or can be balancing balls. The balancing ring can include one or more interior baffles. Although a single balancing ring or apparatus 190 is shown in FIG. 2, any number of such rings or apparatuses can be included in laundry treatment apparatus 100 and can be placed according to any known or desirable configuration. For example, two balancing rings can be respectively placed at the front and back of basket 120.

As further shown in FIG. 2, laundry treatment apparatus 100 includes a detergent dispenser 200. Detergent dispenser 200 may include features for receiving various wash treatment additives (e.g., fluid detergent, powder detergent, fabric softener, bleach, powder or any other suitable liquid) and dispensing or directing them to wash fluid compartment 119 of tub 114 during operation of laundry treatment apparatus 100. Detergent dispenser 200 will be described in further detail herein.

Operation of laundry treatment apparatus 100 is controlled by a processing device or controller 180 that is operatively coupled to control panel 108 for user manipulation to select washing cycles and features. In response to user manipulation of control panel 108, controller 180 operates the various components of laundry treatment apparatus 100 to execute selected machine cycles and features, which will be described in further detail herein.

Controller 180 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 108 and other components of laundry treatment apparatus 100 may be in communication with controller 180 via one or more signal lines or shared communication busses.

In an illustrative example of operation of laundry treatment apparatus 100, laundry items are loaded into basket 120, and a washing operation is initiated through operator manipulation of input selectors 110. Tub 114 may be filled with water and one or more wash treatment additives from detergent dispenser 200 to form a wash fluid. One or more valves of a water inlet valve 195 can be actuated by controller 180 to provide for filling tub 114 to the appropriate level for the amount (or number) of articles being washed. Water inlet valve 195 is in fluid communication with a water source, such as e.g., a hot water heater and/or a municipal water line. Once tub 114 is properly filled with wash fluid, the contents of basket 120 may be agitated with ribs 126 for cleansing of laundry items in basket 120.

After the agitation phase (e.g., first agitation phase, second agitation phase, etc.) of the wash cycle is completed, tub 114 may be drained. Laundry articles may then be rinsed by again adding wash fluid to tub 114 depending on the particulars of the cleaning cycle selected by a user, and ribs 126 may again provide agitation within wash chamber 121. One or more spin cycles may also be used. In particular, a spin cycle may be applied after the wash cycle and/or after the rinse cycle in order to wring wash fluid from the articles being washed. During the spin cycle, basket 120 is rotated at relatively high speeds.

While described in the context of a specific embodiment of horizontal axis laundry treatment apparatus 100, it will be understood that horizontal axis laundry treatment apparatus 100 is provided by way of example only. Other laundry treatment apparatuses having different configurations, different appearances, and/or different features may also be utilized with the present subject matter as well, including, for example, vertical axis laundry treatment apparatuses. Thus, the teachings of the present disclosure are not limited to use with laundry treatment apparatus 100.

Figure 3:
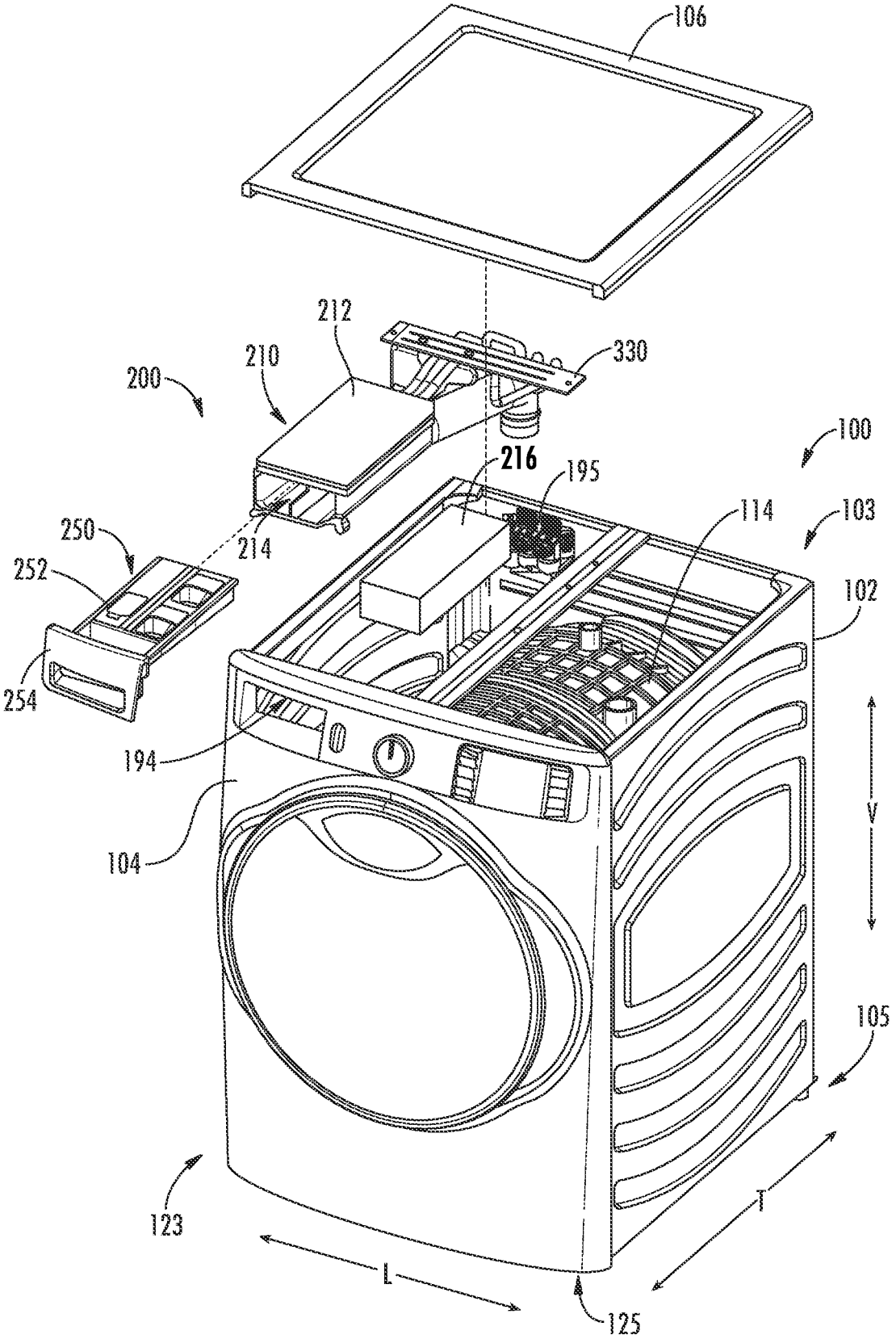
FIG. 3 provides a partial exploded perspective view of the dispensing assembly of the laundry treatment apparatus appliance of FIG. 1.

FIG. 3 provides a view of a detergent dispenser 200 of the laundry treatment apparatus of FIGS. 1 and 2 according to an exemplary embodiment of the present disclosure. More specifically, FIG. 3 provides a partial exploded perspective view of detergent dispenser 200. As shown in FIG. 3, detergent dispenser 200 may include a diffuser assembly 210 and drawer assembly 250. Diffuser assembly 210 may have a manifold 212 that has a generally rectangular shape. Manifold 212 may extend between a front and a back, e.g., along the transverse direction T, between a top and a bottom, e.g., along the vertical direction V, and between a first side and a second side, e.g., along the lateral direction L. Further, manifold 212 may define an interior volume 214. Interior volume 214 of manifold 212 may be sized to receive at least portion of drawer assembly 250. Drawer assembly 250 may be slidably received within manifold 212 (i.e., within interior volume 214 of manifold 212) between a withdrawn position and a retracted position. That is, drawer assembly 250 may be movable between the withdrawn position and the retracted position, e.g., along the transverse direction T. In the withdrawn position, drawer assembly 250 may be at least partially withdrawn from manifold 212 so that a user may readily access one or more additive compartments of drawer assembly 250, e.g., to fill one of the compartments with an additive. In the retracted position, drawer assembly 250 may be received within manifold 212, e.g., so that one or more of the additive compartments of drawer assembly 250 are in fluid communication with water inlet valve 195 and tub 114 during operation of laundry treatment apparatus 100. Generally, drawer assembly 250 may include a drawer 252 and a handle 254. A user may grasp handle 254 of drawer assembly 250 to slide or move drawer assembly 250 between the withdrawn and retracted positions. An opening 194 defined by front panel 104 may allow drawer assembly 250 to slide or move between the withdrawn and retracted positions.

Detergent dispenser may include a bulk tank 216. Bulk tank 216 may be in fluid communication with drawer 252 and tub 114. Accordingly, the user may supply a large amount of detergent to drawer 252 which in turn is stored in bulk tank 216. Bulk tank 216 may store detergent for use in laundry treatment apparatus 100 (e.g., during a washing cycle). For instance, bulk tank 216 may store an amount of detergent that is greater than an amount of detergent used for an individual washing cycle. In some embodiments, bulk tank 216 stores multiple washing cycle's worth of detergent. Accordingly, detergent may be supplied to tub 114 from bulk tank 216 without requiring a user to supply detergent to drawer 252 before each washing cycle. As explained in more detail below, this may allow multiple doses of detergent to be supplied to tub 114 within a single washing cycle, improving a washing performance.

Figure 4:
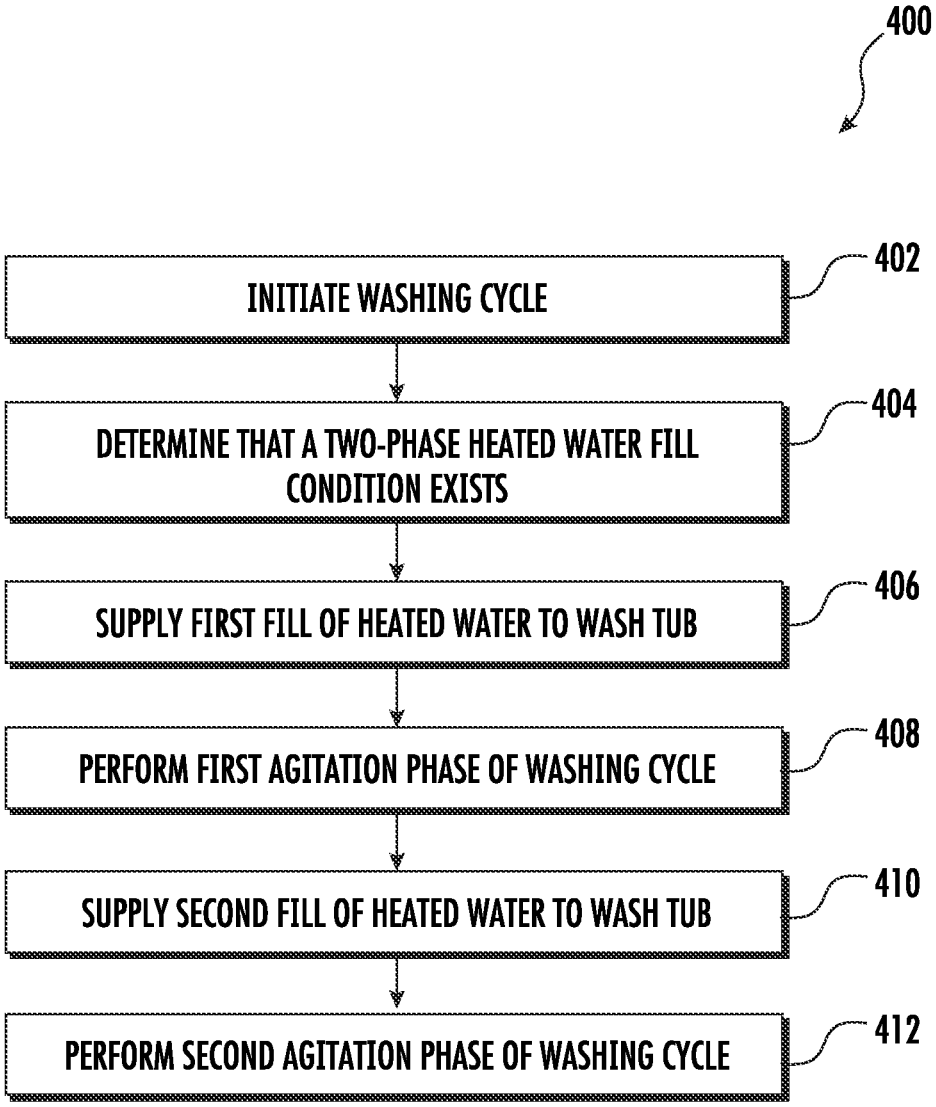
FIG. 4 provides a flow chart illustrating a method of operating a laundry treatment apparatus.

Referring now to FIG. 4, a method 400 of operating a laundry treatment apparatus (e.g., laundry treatment apparatus 100) will be described herein. It should be noted that this method may be applicable to any suitable laundry treatment apparatus, and is not limited to laundry treatment apparatus 100 described above.

In one embodiment, a user may select a washing option and/or a washing cycle to be performed by the laundry treatment apparatus. The washing cycle may include, for example, a Delicate cycle, a Normal cycle, a Cotton cycle, a White or Colors cycle, a Towels cycle, etc. It should be noted that the washing cycle is not limited to the list above and may include any suitable cycle. The washing option may include, for example, an auto soak option, a turbidity sensor feedback option, a high spin option, a multiple rinse option, etc. It should be noted that the washing option is not limited to the list above and may include any suitable option. Upon selecting a washing option and/or washing cycle, the method may commence at step 402.

At step 402, method 400 may include initiating a washing cycle to wash a washing load. The washing cycle may be the washing cycle selected by the user. Additionally or alternatively, the washing cycle may include one or more washing options as selected by the user. In some embodiments, the washing cycle is an automatic washing cycle. For example, the laundry treatment apparatus may include one or more sensors (e.g., weight sensors, turbidity sensors, optical sensors, etc.) that are configured to measure various attributes of the washing load provided in the laundry treatment apparatus. The one or more sensors may then provide the measured attributes to a controller to determine an appropriate washing cycle to be initiated. Additionally or alternatively, the controller may determine washing options to be added to the washing cycle. The washing cycle may include a combination of user selections and automatically determined options.

At step 404, method 400 may include determining that the washing cycle includes a two-phase heated or hot water fill condition. The two-phase heated water fill condition may be triggered under a variety of circumstances that require extra heated water, or a higher initial detergent concentration. In detail, effective enzymes that perform cleaning action in detergent may lose efficacy when mixed with large amounts of water, or under certain washing conditions. Therefore, it would be advantageous to have two separate fills of heated water supplied to a washing load to provide a more effective and satisfactory wash operation. It should be noted that the two-phase heated water fill condition may be determined at any time during the performance of the washing cycle, and as such, the order of operation of the recited steps is not limited strictly to the order presented in FIG. 4. The two-phase heated water fill condition may be determined according to a user input. For example, the user may input a washing cycle for which a duration of the washing cycle is greater than a predetermined time period. The duration of the washing cycle may include an agitation phase, a rinse phase, a spin phase, and a drain phase, for example. However, any combination and number of phases may be included in the washing cycle. In some embodiments, the duration of the agitation phase may be limited to the duration of the one or more agitation phases. The predetermined time period may be between fifteen minutes and thirty minutes. In one example, the predetermined time period is twenty minutes.

Hereinafter, the term "heated water" or "hot water" may pertain to water that is supplied to the tub at a temperature that is elevated relative to tap or municipal water. For instance, heated water may be at a temperature that is elevated relative to any water that is already present within the basket. Additionally or alternatively, heated water may be at a temperature that is greater than room temperature. For example, heated water may be between 90° and 160° Fahrenheit. Accordingly, supplying a fill (e.g., first fill, second fill, etc.) of heated water encompasses providing water heated to a temperature that is elevated relative to tap water to the basket.

In detail, the controller may determine that the duration of the agitation phase will be greater than the predetermined time period (e.g., twenty minutes). As such, the heated water may lose temperature and effectiveness before the agitation period is completed. Therefore, the controller determines that the two-phase condition exists, or is satisfied. The controller may then split the agitation phase into a first agitation phase and a second agitation phase. The number of agitation phases is not limited to two, and may include three or more agitation phases. In some embodiments, the first agitation phase and the second agitation phase are equal in duration. For example, the first agitation phase and the second agitation phase may be fifteen minutes each. Additionally or alternatively, the first agitation phase and the second agitation phase may have different durations. For example, the first agitation phase may be fifteen minutes and the second agitation phase may be ten minutes. The durations of the first and second (and potentially third and so on) agitation phases are not limited to these examples, as one having skill in the art would understand.

In some embodiments, the two-phase heated water fill condition exists when an auto soak option is selected by the user. Therefore, the first fill of heated water would decrease in temperature before the agitation phase (e.g., the first agitation phase) begins. For example, the user may select a wash cycle that includes an auto soak feature. The auto soak option may be incorporated before the agitation phase (e.g., before the first agitation phase). It should be noted that the auto soak option may be incorporated at any suitable time during the washing cycle, such as between agitation phases, for example. Additionally or alternatively, the auto soak option may replace the first agitation phase in some embodiments. During the auto soak, the washing load may sit idly in the basket with a predetermined amount of water. The auto soak option may have a predetermined duration.

In some embodiments, the two-phase heated water fill condition may be satisfied when a soil level of the washing load is above a predetermined soil level. For example, the controller may obtain a predetermined soil level. The predetermined soil level may be set by the user, may be preprogrammed, or may be determined at the beginning of each washing cycle. In detail, the laundry treatment apparatus may include a sensor for determining a soil level in the washing load. The sensor may be a turbidity sensor, for example. The sensor may sense a soil level of the washing load prior to initiating the washing cycle. In some embodiments, the sensor senses the soil level of the washing load at multiple times during the washing cycle. The sensor may then send the sensed soil level to the controller. The controller may then compare the sensed soil level with the predetermined soil level. Upon determining that the sensed soil level is above the predetermined soil level, the controller may determine that the two-phase heated water fill condition is present.

At step 406, the method may include supplying a first fill of heated water to the wash tub. Upon determining that the two-phase heated water fill condition exists, the controller may create a washing plan (e.g., including the first agitation cycle, the second agitation cycle, etc.). Accordingly, the first fill of heated water may be supplied to the wash tub (e.g., together with detergent via a detergent dispenser). The first fill of heated water may be supplied to the tub together with a first dose of detergent. The first dose of detergent may include a predetermined amount of detergent. The predetermined amount of detergent may correspond to a size (e.g., weight) of the washing load, a determined soil level of the washing load, a type of washing load (e.g., cottons, wool, etc.), a wash temperature or wash water amount selected by the user, or the like. The predetermined amount of water may correspond to a size (e.g., weight) of the washing load, a determined soil level of the washing load, a type of washing load (e.g., cottons, wool, etc.), a wash temperature as selected by the user, or the like. Thus, the first dose of detergent and the first amount of water may be supplied to the tub at a prescribed temperature together with the washing load. The prescribed temperature may be determined according to the soil level of the washing load, the type of washing load, or the like, and may include the temperatures discussed above with respect to heated water.

At step 408, the method may include performing the first agitation phase of the washing cycle. With the washing load, the first dose of detergent, and the first amount of heated water in the washing tub, the controller may perform the first agitation phase. The first agitation phase may be less than or equal to twenty minutes. The duration of the first agitation phase is not limited, however, and may be less than or equal to twenty-five minutes, less than or equal to thirty minutes, etc. The first agitation phase may thus agitate the washing load together with the first dose of detergent and the first amount of heated water.

At step 410, the method may include supplying a second fill of heated water to the wash tub. For example, according to the washing plan described above, the controller may determine the second fill of heated water which is desirable for the second agitation phase of the two-phase heated water fill condition. After completing the first agitation phase, the second fill of heated water may be supplied to the tub. Advantageously, the washing cycle may be "refreshed" or "replenished" with heated water to increase a washing performance and thus provide cleaner washing loads at the conclusion of the washing cycle. The second fill of heated water may include a predetermined amount of detergent. The second dose of detergent may be equal to the first dose of detergent. In some embodiments, the second dose of detergent is different from the first dose of detergent. In other words, the second dose of detergent may be less than the first dose of detergent, or may be greater than the first dose of detergent.

The second fill of heated water may be a predetermined amount. The second fill of heated water may be equal to the first fill of heated water in volume. In some embodiments, the second fill of heated water is different from the first fill of heated water in volume. In other words, the second fill of heated water may be less than the first fill of heated water, or may be greater than the first fill of heated water in volume. In some embodiments, the second fill of heated water is supplied to the wash tub in addition to the first fill of heated water. In other words, the first amount of water may not be drained from the wash tub prior to adding the second fill of heated water. Additionally or alternatively, the first fill of heated water may be drained from the wash tub prior to adding the second fill of heated water. Additionally or alternatively, other cycles may be performed between the first agitation phase and the second agitation phase. For example, a spin phase may be performed between the first agitation phase and the second agitation phase.

At step 412, the method may include performing a second agitation phase of the washing cycle. Once the second fill of heated water is added to the wash tub, the controller may instruct the laundry treatment apparatus to perform the second agitation phase. A duration of the second agitation phase may be equal to a duration of the first agitation phase. In some embodiments, the duration of the second agitation phase is different from the duration of the first agitation phase. For example, the second agitation phase may be longer than the first agitation phase, or may be shorter than the first agitation phase. Additional phases or cycles may be performed subsequent to the second agitation phase. For example, a spin phase may be performed, a rinse phase may be performed, and a drain phase may be performed, as is well known in the art.

Additionally or alternatively, a third agitation phase may be performed. The third agitation phase may include a third dose of detergent and a third fill of heated water. In some embodiments, the third agitation phase may only include a third amount of heated water. The third agitation phase may be performed after completion of the second agitation phase. Additional phases may be included between the second agitation phase and the third agitation phase. The third fill of heated water and the third dose of detergent may be added to the wash tub in a similar manner as described above with reference to the first dose of detergent and first amount of water, and the second dose of detergent and second amount of water.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a laundry apparatus, the laundry apparatus comprising a tub, the method comprising:

initiating a washing cycle of a washing load;

determining that the washing cycle comprises a two-phase heated water fill condition, wherein determining that the washing cycle comprises the two-phase heated water fill condition comprises determining that a length of an agitation phase of the washing cycle is greater than a predetermined time period;

splitting the agitation phase into a first agitation phase and a second agitation phase, wherein the first agitation phase comprises a first duration and the second agitation phase comprises a second duration, and wherein each the first duration and the second duration is less than the predetermined time period;

supplying a first fill of heated water to the tub in response to splitting the agitation phase;

performing a first agitation phase of the washing cycle, after supplying the first fill of heated water to the tub;

supplying a second fill of heated water to the tub after performing the first agitation phase; and performing a second agitation phase of the washing cycle after supplying the second fill of heated water to the tub.

2. The method of claim 1, wherein the predetermined time period is greater than twenty minutes.

3. The method of claim 1, wherein determining that the washing cycle comprises the two-phase heated water fill condition further comprises:

determining that the washing cycle includes an auto soak phase.

4. The method of claim 1, wherein the laundry apparatus further comprises a turbidity sensor configured to determine a soil level of the washing load, and wherein determining that the washing cycle comprises the two-phase heated water fill condition further comprises:

obtaining a predetermined soil level threshold; and determining a soil level of the washing load is above the predetermined soil level threshold via the turbidity sensor.

5. The method of claim 1, wherein the first agitation phase is less than or equal to twenty minutes in duration.

6. The method of claim 1, wherein the first fill of heated water is supplied to the tub together with a dose of detergent via a detergent dispenser.

7. The method of claim 1, wherein the second fill of heated water is supplied to the tub via a water supply valve.

8. The method of claim 7, wherein the second fill of heated water is supplied in addition to the first fill of heated water.

9. A method for operating a laundry apparatus, the laundry apparatus comprising a tub and a turbidity sensor, the method comprising:

initiating a washing cycle of a washing load;

obtaining a predetermined soil level threshold for the washing load;

supplying a first fill of heated water to the tub after obtaining the predetermined soil level threshold;

performing a first agitation phase of the washing cycle after supplying the first fill of heated water to the tub;

determining a soil level of the washing load is above the predetermined soil level threshold via the turbidity sensor after performing the first agitation phase;

determining that the washing cycle comprises a two-phase heated water fill condition in response to determining the soil level of the washing load is above the predetermined soil level threshold;

supplying a second fill of heated water to the tub in addition to the first fill of heated water; and performing a second agitation phase of the washing cycle.

* * * * *